US010655895B2

(12) United States Patent
Haack et al.

(10) Patent No.: US 10,655,895 B2
(45) Date of Patent: May 19, 2020

(54) CLIMATIC TEST CHAMBER WITH STABLE CASCADING DIRECT EXPANSION REFRIGERATION SYSTEM

(71) Applicant: Weiss Technik North America, Inc., Grand Rapids, MI (US)

(72) Inventors: Christian Haack, Marburg (DE); Benjamin J. DeJager, Grand Rapids, MI (US)

(73) Assignee: Weiss Technik North America, Inc., Grand Rapids, MI (US)

( * ) Notice: Subject to any disclaimer, the term of this patent is extended or adjusted under 35 U.S.C. 154(b) by 199 days.

(21) Appl. No.: 15/818,884

(22) Filed: Nov. 21, 2017

(65) Prior Publication Data

US 2018/0320933 A1 Nov. 8, 2018

Related U.S. Application Data

(60) Provisional application No. 62/501,175, filed on May 4, 2017.

(51) Int. Cl.
*F25B 7/00* (2006.01)
*F25B 5/02* (2006.01)
(Continued)

(52) U.S. Cl.
CPC ..... *F25B 7/00* (2013.01); *F25B 5/02* (2013.01); *F25B 5/04* (2013.01); *F25B 41/04* (2013.01);
(Continued)

(58) Field of Classification Search
CPC ..... F25B 7/00; F25B 5/02; F25B 5/04; F25B 2341/0662; F25B 41/04; F25B 41/062; F25D 11/04
See application file for complete search history.

(56) References Cited

U.S. PATENT DOCUMENTS 699,391 A 5/1902 Johnson
715,242 A 12/1902 Burrington
(Continued)

FOREIGN PATENT DOCUMENTS

CN 204943954 U 1/2016
JP S59-167369 11/1984
(Continued)

OTHER PUBLICATIONS

European Search Report from corresponding European Patent Application No. 17204882.9, filed on May 23, 2018, entitled Climatic Test Chamber With Stable Cascading Direct Expansion Refrigeration System.

*Primary Examiner* — Nelson J Nieves
(74) *Attorney, Agent, or Firm* — Gardner Linn

(57) ABSTRACT

A climatic test system includes a test chamber adapted to hold a unit under test within the housing, and a refrigeration system that is adapted to cool air within the chamber. The refrigeration system includes a high stage, a low stage, and a cascade heat exchanger between said high and low stages. The low stage includes a refrigeration cycle having a low stage compressor, a low stage condenser, a low stage expansion device, and a low stage evaporator. The low stage evaporator is in heat exchange relationship with the chamber. The high stage includes a refrigeration cycle having a high stage compressor, a high stage condenser, and a cascade heat exchanger evaporator that is in heat exchange relationship with the low stage condenser, thereby defining the cascade heat exchanger. The high stage further has a first high stage expansion device supplying refrigerant from the high stage condenser to the cascade heat exchanger evaporator during cascade operation. The high stage further includes one or more additional high stage evaporator in heat exchange relationship with the test chamber and one or more additional high stage expansion device supplying
(Continued)

refrigerant from the high stage condenser to the additional high stage evaporator(s) during single stage operation. A control controls operation of the refrigeration system in at least a single stage operation and a cascade operation. The additional high stage evaporator(s) is connected with the cascade heat exchanger evaporator wherein mass flowing through said at least one additional evaporator flows through the cascade heat exchanger evaporator.

9 Claims, 4 Drawing Sheets

(51) Int. Cl.
*F25B 41/06* (2006.01)
*F25B 5/04* (2006.01)
*F25B 41/04* (2006.01)

(52) U.S. Cl.
CPC .... *F25B 41/062* (2013.01); *F25B 2341/0662* (2013.01); *F25B 2400/0403* (2013.01); *F25B 2700/2117* (2013.01)

(56) References Cited

U.S. PATENT DOCUMENTS 4,300,357 A 11/1981 Jacyno
4,550,574 A * 11/1985 Hohman ..... F25B 5/00 62/196.3
6,189,329 B1 2/2001 Peterson
10,422,562 B2 * 9/2019 Pereira Zimmermann ..... F25B 7/00
2006/0090506 A1 * 5/2006 Meister ..... F25B 5/04 62/513
2009/0093917 A1 * 4/2009 Smith ..... F25B 49/005 700/300
2009/0120117 A1 * 5/2009 Martin ..... F25B 7/00 62/246
2011/0072836 A1 * 3/2011 Wang ..... F25B 7/00 62/79
2011/0120168 A1 * 5/2011 Choi ..... F25B 7/00 62/324.6
2011/0304466 A1 * 12/2011 Bair ..... F25D 29/008 340/585
2013/0199232 A1 * 8/2013 Natarajan ..... F25B 7/00 62/335
2013/0233003 A1 * 9/2013 Piesker ..... B64D 13/06 62/115
2014/0250925 A1 * 9/2014 Prabowo ..... F25B 49/005 62/62
2015/0153086 A1 * 6/2015 Takayama ..... F25B 5/04 62/228.3
2015/0176866 A1 * 6/2015 Takayama ..... F25B 47/022 62/140
2016/0334143 A1 * 11/2016 Xie ..... F25B 7/00
2017/0021698 A1 * 1/2017 Hatakeyama ..... F25B 7/00
2017/0030619 A1 * 2/2017 Kim ..... F25B 5/04
2017/0167758 A1 * 6/2017 Tsai ..... F25B 7/00
2017/0248349 A1 * 8/2017 Kujak ..... F25B 9/10
2019/0093926 A1 * 3/2019 Haack ..... C09K 5/041

FOREIGN PATENT DOCUMENTS

JP S61 259059 A 11/1986
JP H01263461 A 10/1989
JP H10 103800 A 4/1998
JP 2000-121181 A 4/2000
JP 2002-346403 A 12/2003
KR 2013 0086864 A 8/2013

* cited by examiner

High Load Cascade

Low Load Cascade

CLIMATIC TEST CHAMBER WITH STABLE CASCADING DIRECT EXPANSION REFRIGERATION SYSTEM

CROSS REFERENCE TO RELATED APPLICATIONS

The present application claims benefit of U.S. patent application Ser. No. 62/501,175, filed May 4, 2017, the disclosure of which is hereby incorporated herein by reference in its entirety.

BACKGROUND OF THE INVENTION

The present application is directed to a climatic test chamber and a refrigeration system that is adapted to cool the test chamber.

Climatic test chambers are used to test products that are exposed to a range of climatic conditions in order to determine how the products will perform in such conditions. Such test chambers may require a refrigeration system that is capable of achieving a wide range of temperature and humidity conditions such as from positive 180 degrees Centigrade to minus 73 degrees Centigrade in the test space. To achieve such low temperatures, it is known to use cascade refrigeration systems having high stage and low temperature stage linked by an intermediate cascade heat exchanger. The cascade heat exchanger acts as the evaporator on the high stage system and the condenser on the low stage system allowing the low stage to operate at much lower temperatures. Such cascade refrigeration systems may also be operable in single stage mode in which the high stage system has one or more additional climate control evaporator(s) that are capable of supplying high stage temperature cooling and/or humidity control to the test chamber. The low stage compressor is off during single stage mode.

SUMMARY OF THE INVENTION

In prior systems the suction lines from the additional climate control evaporator(s) in the high stage are routed after the outlet of the cascade heat exchanger evaporator. Also, a discharge bypass valve and associated line meant to protect the high stage compressor from excessive compression ratios and dangerously low suction pressure is routed after the outlet of the cascade heat exchange evaporator during low load cascade operation and single stage operation. This arrangement requires highly variable cooling load to temper and balance discharge bypass gas heat. This leads to unnecessary system complexity and may result in unwanted control loop oscillations. Moreover, there is no mass flow of refrigerant and entrained lubricant through the high stage evaporator of the cascade heat exchanger during single stage operation. This could result in lubricant being logged (accumulated) in the evaporator of the cascade heat exchanger, which may cause pre-mature wear of the high stage compressor as well as problems controlling the refrigeration system. Aspects of the present invention are directed to overcoming drawbacks of prior system.

A climatic test system and refrigeration system for use with such test system, according to an aspect of the invention, includes a test chamber adapted to hold a unit under test within the housing and a refrigeration system that is adapted to supply cooling air to the chamber. The refrigeration system has a high stage and a low stage and a cascade heat exchanger between said high and low stages. The low stage includes a refrigeration cycle having a low stage compressor, a low stage condenser, a low stage expansion device, and a low stage evaporator. The low stage evaporator is in heat exchange relationship with the housing. The high stage includes a refrigeration cycle having a high stage compressor, a high stage condenser, and a cascade heat exchanger evaporator that is in heat exchange relationship with the low stage condenser, thereby defining the cascade heat exchanger. The high stage further has a first high stage expansion device supplying refrigerant from the high stage condenser to the cascade heat exchanger evaporator during cascade operation and one or more additional high stage evaporator(s) with one or more additional high stage expansion device(s) supplying refrigerant from the high stage condenser to the additional high stage evaporator(s) during single stage operation. The additional high stage evaporator(s) are connected to supply refrigerant through the high stage cascade heat exchanger evaporator during the single stage operation. The additional high stage evaporator(s) are in heat exchange with the test chamber.

A climatic test system and refrigeration system for use with such system, according to an aspect of the invention, includes a test chamber adapted to hold a unit under test within the housing and a refrigeration system that is adapted to supply cooling air to the test chamber. The refrigeration system includes a high stage, a low stage, and a cascade heat exchanger between said high and low stages. The low stage includes a refrigeration cycle having a low stage compressor, a low stage condenser, a low stage expansion device, and a low stage evaporator. The low stage evaporator is in heat exchange relationship with the air in the test chamber. The high stage includes a refrigeration cycle having a high stage compressor, a high stage condenser, and a cascade heat exchanger evaporator that is in heat exchange relationship with the low stage condenser thereby defining the cascade heat exchanger. The high stage further has a first high stage expansion device supplying refrigerant from the high stage condenser to the cascade heat exchanger evaporator during cascade operation. The high stage further includes one or more additional high stage evaporator(s) and one or more additional high stage expansion device(s) supplying refrigerant from said high stage condenser to the additional high stage evaporator(s) during single stage operation a control controls operation of the refrigeration system in at least a single stage operation and a cascade operation. The control operates the additional high stage expansion device(s) during single stage operation and not during cascade operation. The control operates the high stage compressor and the low stage compressor during cascade operation and only the high stage compressor during single stage operation. The additional high stage evaporator(s) is connected in series with said high stage cascade evaporator wherein refrigerant flowing through the at least one additional evaporator flows through the high stage cascade evaporator.

The first high stage expansion device may be a controllable expansion device. The controllable expansion device may respond to temperature and pressure at the outlet of the cascade heat exchanger evaporator. The high stage refrigeration system may include at least two additional high stage evaporators each having at least one high stage expansion device. One of the at least two additional high stage evaporators may supply high stage temperature cooling to the test chamber. One of the at least two additional high stage evaporators may supply dehumidification to the test chamber.

The high stage condenser may be liquid cooled or air cooled. A high stage compressor bypass may be provided to direct gaseous refrigerant from an outlet of the high stage compressor through the cascade heat exchanger evaporator during the single stage operation. The high stage compressor bypass may direct refrigerant from an outlet of the high stage compressor through the high stage evaporator during cascade operation at low cooling demand or during single stage operation.

Aspects of the present invention provide a more consistent heat load in the cascade heat exchanger. This provides a simplified and more stable system. During high load conditions, the cooling load in the cascade heat exchanger is exclusively due to the low stage system. In low load cascade operation the load in the cascade heat exchanger is partially from the low stage system and partially from the energy of the bypass of the high stage compressor. In single stage operation the cooling load is from the bypass of the high stage compressor and flow from the additional high stage evaporator(s). In all load conditions, there is sufficient mass flow through the high stage evaporator of the cascade heat exchanger to essentially prevent oil logging in the high stage evaporator. The cascade heat exchanger becomes an efficient mixing chamber for suction line gas from the additional high stage evaporator(s), the bypassed hot gas, cool vapor, and lubricant, thus providing optimal operation of the high stage compressor.

While aspects of the invention are illustrated for use with a climatic test chamber, it should be understood that the refrigeration system may find other applications where a wide range of temperatures are desired. These and other objects, advantages, and features of this invention will become apparent upon review of the following specification in conjunction with the drawings.

DETAILED DESCRIPTION OF THE PREFERRED EMBODIMENT

Figure 1:
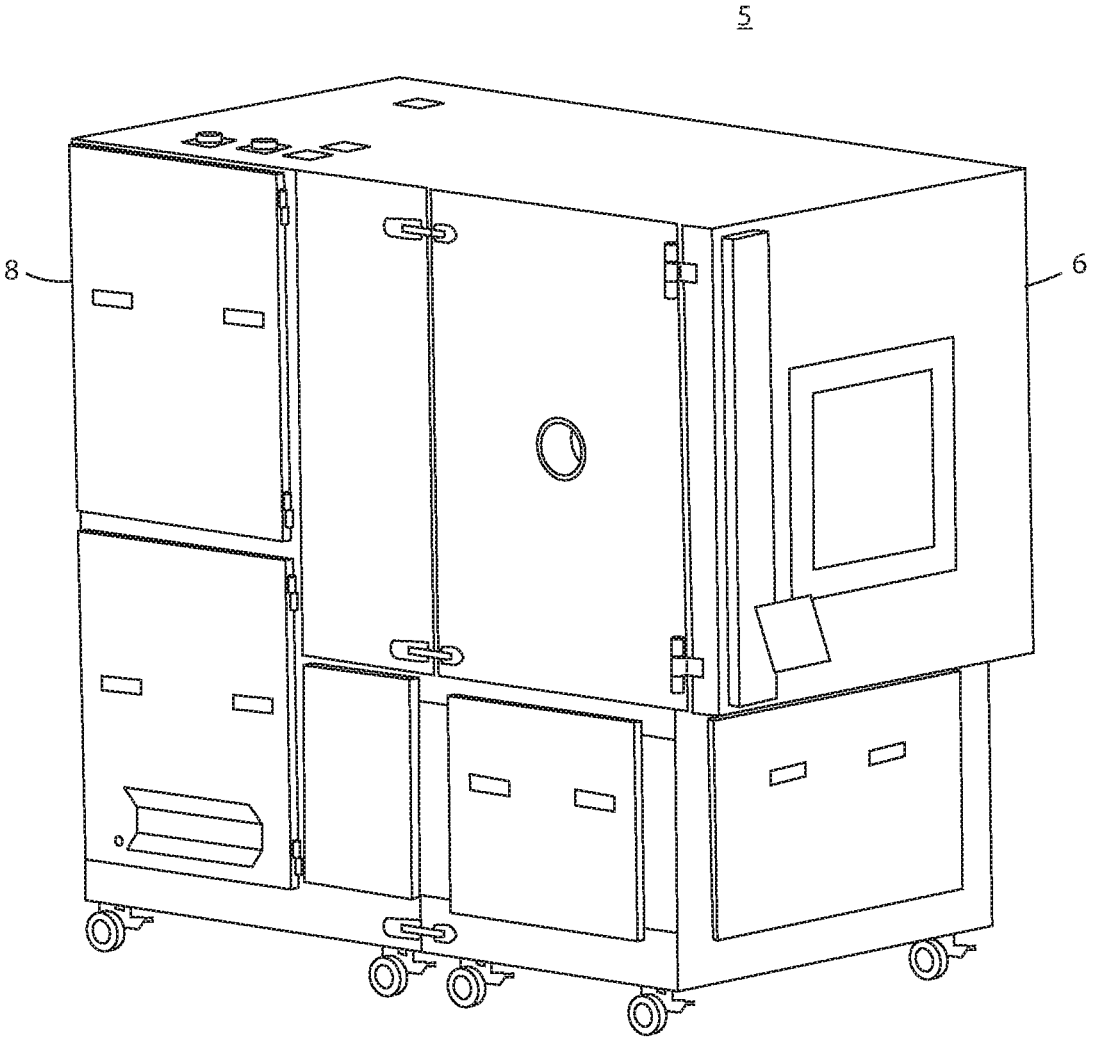
FIG. 1 is a perspective view of an environmental test chamber that illustrates the environment in whether the invention is used.

Referring to the drawings and the illustrative embodiment depicted therein, a climatic test system 5 includes a test chamber 6 adapted to hold a unit under test within the housing and an equipment compartment 8 housing, a refrigeration system 10 that is adapted to cool the air in the test chamber. Such climatic test systems are generally known in the art and supplied by the present assignee, Weiss Technik North America, Inc. Refrigeration system 10 includes a high stage 12 and a low stage 14 coupled together with a cascade heat exchanger 16. Cascade heat exchanger 16 contains the low stage heat exchanger condenser 20 and the high stage heat exchanger evaporator 30.

Low stage 14 includes a refrigeration cycle having a low stage compressor 18, low stage condenser 20, a low stage expansion device 22, and a low stage evaporator 24. The low stage evaporator is in heat exchange relationship with the test chamber to expose product in the test chamber to a user defined temperature climate.

The high stage 12 includes a refrigeration cycle having a high stage compressor 26, a high stage condenser 28, which may be air cooled or liquid cooled, and a high stage evaporator 30, that is in heat exchange relationship to low stage condenser 20 thereby defining cascade heat exchanger 16. High stage 12 further includes a first high stage expansion device 32 supplying refrigerant from the high stage condenser 28 to the high stage evaporator 30 during cascade operation. High stage 12 further includes at least one additional high stage evaporator 34*a* and/or 34*b*, and at least one additional high stage expansion device 36*a* and/or 36*b* supplying refrigerant from high stage condenser 28 to respective additional high stage evaporator(s) 34*a*, 34*b* during single stage operation of refrigeration system 10. The additional high stage evaporator(s) are in heat exchange relationship with the test chamber.

Figure 2:
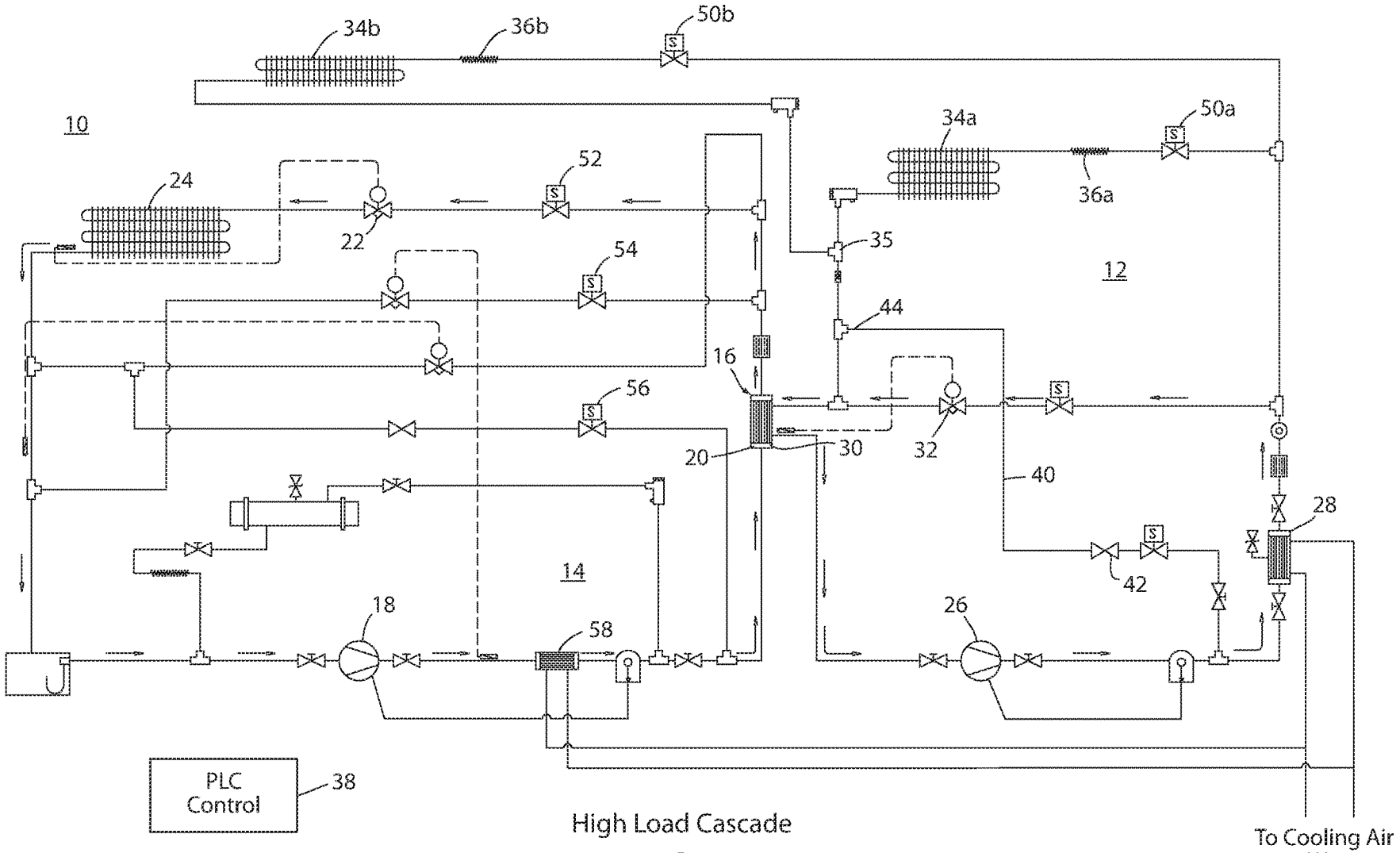
FIG. 2 is a schematic diagram of a refrigeration system according to an embodiment of the invention operating in high load cascade stage condition.
Figure 3:
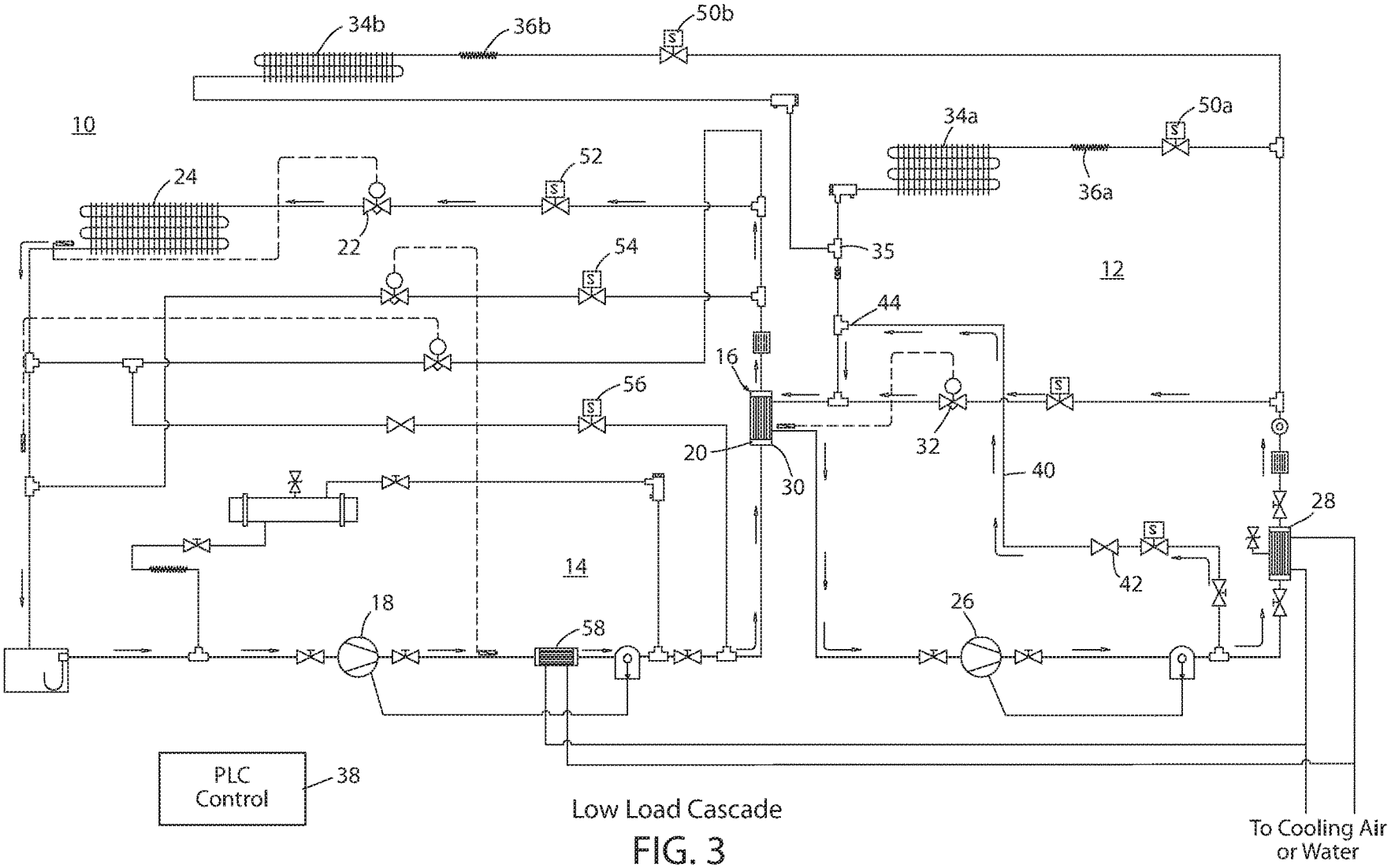
FIG. 3 is the same view as FIG. 2 with the refrigeration system operating a low load cascade stage condition.
Figure 4:
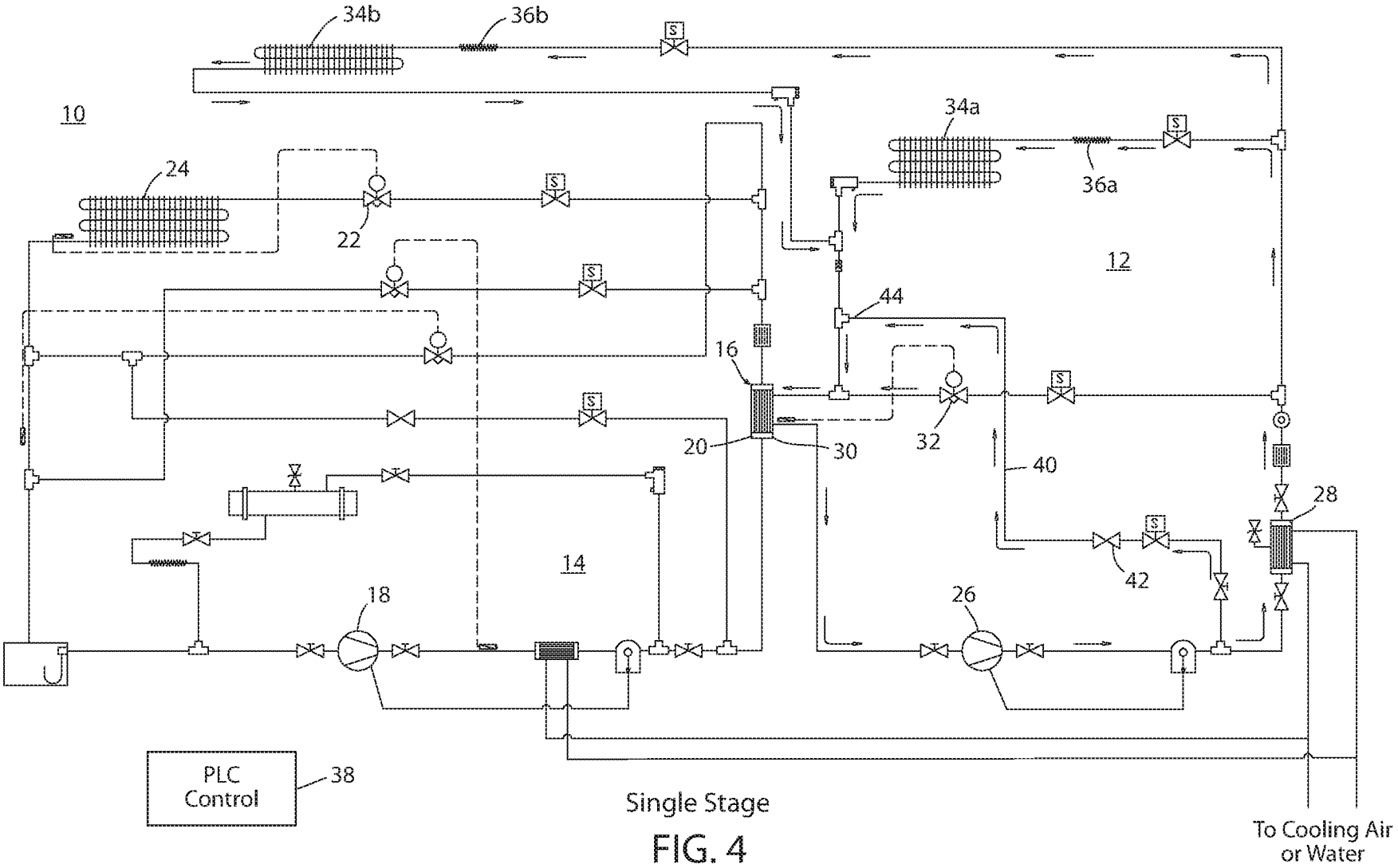
FIG. 4 is the same view as FIG. 2 with the refrigeration system operating in a single stage operation.

A control 38, such as a programmable logic controller (PLC) or other know control operates refrigeration system 10 in at least a single stage operation, shown in FIG. 4, and cascade operation shown in FIGS. 2 and 3. Control 38 operates the additional high stage expansion device 36*a*, 36*b* during single stage operation (FIG. 4) and not during cascade operation (FIGS. 2 and 3) and operates low stage compressor 18 during cascade operation (FIGS. 2 and 3) and not during single stage operation (FIG. 4).

Additional high stage evaporator(s) 34*a*, 34*b* are connected with high stage cascade evaporator 30. In this manner refrigerant that flows through additional high stage evaporator(s) 34*a*, 34*b* flows through the cascade heat exchanger evaporator 30. High stage 12 further includes a bypass line 40 and a discharge bypass valve 42 that causes hot gas from high stage compressor 26 to bypass high stage condenser 28 during low load cascade conditions as shown in FIG. 3 and single stage operation shown in FIG. 4. An output 44 of bypass line 40 is connected between expansion device 32 and high stage evaporator 30. A junction of outputs 35 of additional high stage evaporator 34*a*, 34*b* are introduced between expansion device 32 and heat high stage cascade evaporator 30, thereby also flowing through high stage evaporator 30 even during low load cascade conditions and single stage operation.

During high cooling load conditions refrigeration system 10 operates in cascade fashion as seen in FIG. 2; control 38 energizes low stage compressor 18 and high stage compressor 26. Controllable valves 50*a* and 50*b* are closed. Compressor 26 increases the pressure and temperature of a gaseous refrigerant which discharges heat through high stage condenser 28 to air or water. Liquefied refrigerant flows through expansion device 32, which creates a drop in the pressure and temperature of the liquid refrigerant to high stage evaporator 30, which received heat discharged by low stage condenser 20, and adds the heat to the refrigerant so that the refrigerant boils to a superheated gas.

Low stage compressor 18 increases the pressure and temperature of a gaseous refrigerant, which discharges heat through an auxiliary low stage discharge gas cooler, to be discharged to air or water, and through low stage condenser 20 to be discharged to high stage evaporator 30. Controllable valves 54 and 56 may be closed by control 38, and controllable valve 52 open. Refrigerant flows through expansion device 22 to drop the pressure and temperature of the liquid refrigerant, which flows to low stage evaporator 24, which pulls heat from test chamber 6 to lower the air temperature within the chamber. In the illustrative embodiment, temperature of minus 70 degrees Centigrade or lower are possible although temperature requirements are matched to the application.

During low-load cascade operations (FIG. 3), PLC control 38 compensates from the reduction in refrigeration demand by opening controllable valve 42 to cause hot gas from high stage compressor 26 to bypass high stage condenser 28. This reduces the amount of heat energy discharged by high stage condenser 28.

During a further reduction in load, PLC control 38 enters a single stage operation as shown in FIG. 4. PLC control 38 reenergizes low stage compressor so that refrigeration system 10 operates only high stage 12. The controllable valve in bypass line 40 is opened based on decreasing and predefined suction pressure which generally occurs as a result of lower cooling loads to cause hot gas from high stage compressor 28 to bypass high stage condenser 28. Control 38 opens controllable valves 50*a* and/or 50*b* in order to pass refrigerant through expansion device 36*a*, and additional high stage evaporator 34*a*, and/or through expansion device 36*b*, and additional high stage evaporator 34*b*. Additional high stage evaporators 34*a*, 34*b* are useful to provide slight temperature reduction and/or dehumidification to test chamber 6. However, during single stage operation, low stage evaporator 24 does not provide cooling to test chamber 6.

Since both additional high stage evaporators 34*a*, 34*b* supply mixed high stage mass flow through high stage cascade evaporator 30, mass flow is present during not only cascade operation of refrigeration system 10, but during single stage operation as well. Thereby mass flow is always present in the cascade heat exchanger evaporator 30 to avoid logging of lubricant in the cascade heat exchange evaporator. Also, evaporator 30 becomes an effective mixing chamber for suction line gas, bypassed hot gas, cool refrigerant when needed and lubricant, providing an ideal suction state gas for operation of high stage compressor 26. Thus, more stable operation of refrigeration system 10 is realized over a wide range of load conditions.

While the foregoing description describes several embodiments of the present invention, it will be understood by those skilled in the art that variations and modifications to these embodiments may be made without departing from the spirit and scope of the invention, as defined in the claims below. The present invention encompasses all combinations of various embodiments or aspects of the invention described herein. It is understood that any and all embodiments of the present invention may be taken in conjunction with any other embodiment to describe additional embodiments of the present invention. Furthermore, any elements of an embodiment may be combined with any and all other elements of any of the embodiments to describe additional embodiments.

The embodiments of the invention, in which an exclusive property or privilege is claimed, are defined as follows:

1. Climatic test system, comprising:

a test chamber adapted to hold a unit under test within the chamber;

a refrigeration system that is adapted to cool air within said chamber, said refrigeration system comprising a high stage and a low stage coupled together with a cascade heat exchanger;

said low stage comprising a refrigeration cycle having a low stage compressor, a low stage condenser, a low stage expansion device and a low stage evaporator, said low stage evaporator in heat exchange relationship with said chamber;

said high stage comprising a refrigeration cycle comprising a high stage compressor, a high stage condenser, a cascade heat exchanger evaporator comprising a high stage evaporator that is in heat exchange relationship to said low stage condenser thereby defining said cascade heat exchanger, and a first high stage expansion device supplying refrigerant from said high stage condenser to said cascade heat exchanger evaporator during cascade operation, said high stage further comprising at least one additional high stage evaporator in heat exchange relationship with said test chamber, at least one additional high stage expansion device supplying refrigerant from said high stage condenser to said at least one additional evaporator during single stage operation;

a controller, said controller adapted to operate said refrigeration system in at least a single stage operation and a cascade operation and wherein said controller operates said at least one additional high stage expansion device during the single stage operation and not during the cascade operation and operates said low stage compressor during the cascade operation and not during the single stage operation; and wherein said at least one additional high stage evaporator is connected with said cascade heat exchanger evaporation and wherein said controller operates said at least one additional high stage expansion device during the single stage operation wherein refrigerant mass flowing through said at least one additional evaporator flows through said cascade heat exchanger evaporator during the single stage operation and wherein said controller operates said first high stage expansion device supplying additional refrigerant mass flow from said high stage condenser through said cascade heat exchanger evaporator during the single stage operation.

2. The climate test system as claimed in claim 1 wherein said first high stage expansion device comprises a controllable expansion device.

3. The climate test system as claimed in claim 2 wherein said controllable expansion device is response to temperature at said high stage evaporator.

4. The climate test system as claimed in claim 1 wherein said at least one additional high stage evaporator comprises at least two additional high stage evaporators and wherein said at least one additional high stage expansion device comprises at least two second high stage expansion devices, one of said second high stage expansion devices for each said at least two additional high stage evaporators, and wherein said controller operates said at least two second high stage expansion devices during single stage operation wherein said at least two additional high stage evaporators are connected to jointly supply said refrigerant mass flowing through said high stage evaporator during the single stage operation.

5. The climate test system as claimed in claim 1 wherein said at least one additional high stage evaporator and said at least one additional high stage expansion device are adapted to reduce air temperature within said chamber.

6. The climate test system as claimed in claim 5 wherein said at least one additional evaporator and said at least one additional high stage expansion device are adapted to dehumidify the air within said chamber.

7. The climate test system as claimed in claim 1 wherein said high stage includes a high stage compressor bypass and wherein said controller operates said high stage compressor bypass during single stage operation to direct further additional refrigerant mass from an outlet of said high stage compressor through said high stage evaporator during the single stage operation.

8. The climate test system as claimed in claim 7 wherein said high stage compressor bypass is adapted to direct the further additional refrigerant mass from said outlet of said high stage compressor through said high stage evaporator during the cascade operation when low cooling is demanded.

9. A refrigeration system that is adapted to cool air within a test chamber that is adapted to hold a unit under test, the refrigeration system comprising:

a low stage compressor, a low stage condenser, a low stage expansion device and a low stage evaporator, said low stage evaporator adapted to be in heat exchange relationship with the test chamber;

said high stage comprising a refrigeration cycle comprising a high stage compressor, a high stage condenser, a cascade heat exchanger evaporator comprising a high stage evaporator that is in heat exchange relationship to said low stage condenser thereby defining said cascade heat exchanger and a first high stage expansion device supplying refrigerant from said high stage condenser to said cascade heat exchanger evaporator during cascade operation, said high stage further comprising at least one additional high stage evaporator adapted to be in heat exchange relationship with the test chamber, at least one additional high stage expansion device supplying refrigerant from said high stage condenser to said at least one additional evaporator during single stage operation;

a controller, said controller adapted to operate said refrigeration system in at least a single stage operation and a cascade operation and wherein said controller operates said at least one additional high stage expansion device during single stage operation and not during cascade operation and operates said low stage compressor during cascade operation and not during single stage operation; and wherein said at least one additional high stage evaporator is connected with said cascade heat exchanger evaporation and wherein said controller operates said at least one additional high stage expansion device during single stage operation wherein refrigerant mass flowing through said at least one additional evaporator flows through said cascade heat exchanger evaporator during single stage operation and wherein said controller operates said first high stage expansion device supplying additional refrigerant mass flow from said high stage condenser to said cascade heat exchanger evaporator during single stage operation.

* * * * *